United States Patent [19]

Stroze et al.

[11] Patent Number: 5,035,170

[45] Date of Patent: Jul. 30, 1991

[54] DIRECT DRIVE VARIABLE DISPLACEMENT HYDRAULIC APPARATUS

[75] Inventors: Mark S. Stroze; William G. Durtschi, both of Rockford, Ill.

[73] Assignee: Sundstrand Corporation, Rockford, Ill.

[21] Appl. No.: 400,341

[22] Filed: Aug. 30, 1989

[51] Int. Cl.[5] ..... F04B 13/04

[52] U.S. Cl. ..... 91/486; 91/482; 417/222 R; 417/270

[58] Field of Search ..... 417/222, 270; 91/475, 91/482, 486, 433

[56] References Cited

U.S. PATENT DOCUMENTS

| | | | |
|---|---|---|---|
| 2,979,037 | 4/1961 | Budzich | 91/482 |
| 3,050,014 | 8/1962 | Sullivan | 91/482 |
| 3,117,529 | 1/1964 | Firth et al. | 91/482 |
| 4,875,403 | 10/1989 | Stroze et al. | 91/482 |

FOREIGN PATENT DOCUMENTS

69AD1912 12/1912 United Kingdom .

*Primary Examiner*—A. Michael Chambers

*Attorney, Agent, or Firm*—Wood, Phillips, Mason, Recktenwald & VanSanten

[57] ABSTRACT

In order to eliminate leakage and provide a more efficient system, a variable displacement hydraulic apparatus (10) includes a cylinder block (12) having a plurality of hydraulic cylinders (14) therein. Each of the cylinders (14) has a hydraulic piston (16) disposed therein for reciprocating movement relative thereto. The cylinders (14) and pistons (16) are disposed about an axis (18) of the hydraulic apparatus (10). The hydraulic apparatus (10) also includes a shaft (20) operatively associated with the pistons (16) for relative driven movement therebetween and a valve block (22) having a hydraulic fluid inlet port (24) for supplying hydraulic fluid to the cylinders (14) together with a hydraulic fluid outlet port (26) for returning hydraulic fluid from the cylinders (14). The inlet and outlet ports (24 and 26) communicate with the cylinders (14) through a port plate (28) having at least one port slot (30) therethrough. The port plate (30) is variably angularly positionable relative to the inlet and outlet ports (24 and 26) for varying displacement of the hydraulic apparatus (10). For this purpose, an electrically driven displacement device (32) is directly coupled to the port plate (30) to rotate it upon demand.

18 Claims, 1 Drawing Sheet

DIRECT DRIVE VARIABLE DISPLACEMENT HYDRAULIC APPARATUS

FIELD OF THE INVENTION

The present invention is generally directed to hydraulic apparatus such as motors and pumps and, more particularly, a hydraulic apparatus of the variable displacement type.

BACKGROUND OF THE INVENTION

For various applications, variable displacement hydraulic apparatus such as motors and pumps have demonstrated greater system efficiencies than their fixed displacement counterparts. Typically, a hydraulic system will operate at a variety of loads and speeds and the ability to change flow on command reduces input shaft horsepower requirements and heat generated therein. For such purposes, the variable displacement hydraulic apparatus can be configured in such a manner as to vary the port plate angle in relation to the cylinder block.

To vary the output of a hydraulic apparatus, it is also well known to use a variable swash plate which "wobbles" back and forth to vary the displacement of the pistons therein. When a wobbler is used, the swash plate against which the piston shoes slide is moved about an axis of rotation to change the piston displacement. At one extreme, if the swash plate is precisely perpendicular to the central axis of rotation, no change in displacement would occur as the pistons rotate around the motor centerline.

Another way of regulating the output of a hydraulic apparatus is to rotate the port plate about the centerline of the hydraulic apparatus which causes the inlet and outlet kidneys to move with respect to the wobbler or cam to thereby affect the operation of the apparatus. It will be understood that this technique can be used with either a variable or fixed swash plate as long as the swash plate is always at some non-perpendicular angle relative to the central axis of rotation.

With reference to the second technique wherein the port plate is rotated about its centerline which is also the centerline of the hydraulic apparatus, it has been known to utilize a hydraulic servo valve and piston arrangement to cause the rotational indexing of the port plate. As will be appreciated, the hydraulic servo valve controls the oil ported to the piston arrangement and moves the port plate by some predetermined amount about its centerline relative to the position of the hydraulic apparatus.

As a result, hydraulic apparatus have traditionally utilized hydraulic servo valves to vary displacement. Electrical inputs to the valve control flow to the control piston, thereby changing the angle of the plate, thus changing unit displacement. Unfortunately, such hydraulic servo valves have a serious drawback in that quiescent fluid is oftentimes leaked.

As for other approaches, control of a port plate has been proposed by mechanical and hydromechanical devices of various types. For instance, Budzich U.S. Pat. No. 3,190,232 attempts to control a port plate by means of a piston driven ball and Firth et al. U.S. Pat. No. 3,117,529 attempts to achieve this objective by means of a o rack and pinion arrangement. However, both of these methods of controlling a port plate are less than satisfactory since they would provide unbalanced forces.

The present invention is directed to overcoming the foregoing problems and achieving the resulting objectives.

SUMMARY OF THE INVENTION

It is therefore a principal object of the present invention to provide a hydraulic apparatus utilizing direct drive variable displacement. It is likewise an object of the present invention to provide such an apparatus wherein variable displacement is achieved by means of electrically driving a port plate. It is a further object of the invention to electrically drive a port plate in a manner imparting pure torsion.

An exemplary embodiment of the present invention achieves the foregoing objects in a hydraulic apparatus of the variable displacement type. The hydraulic apparatus includes a cylinder block having a plurality of hydraulic cylinders therein. Each of the hydraulic cylinders has a hydraulic piston disposed therein for reciprocating movement relative thereto. The hydraulic apparatus also is such that the hydraulic cylinders and pistons are disposed about an axis of the apparatus. Additionally, the hydraulic apparatus includes a shaft operatively associated with the hydraulic pistons for relative driven movement therebetween.

In the exemplary embodiment, the hydraulic apparatus includes a valve block having a hydraulic fluid inlet port for supplying hydraulic fluid to the hydraulic cylinders and a hydraulic fluid outlet port for returning hydraulic fluid from the hydraulic cylinders. The hydraulic fluid inlet and outlet ports communicate with the hydraulic cylinders through a port plate having at least one port slot therethrough. With this arrangement, the port plate is variably angularly positionable relative to the hydraulic fluid inlet and outlet ports for varying displacement of the hydraulic apparatus through suitable means for angularly positioning the port plate.

In this connection, the angular positioning means is directly coupled to the port plate. It is also electrically driven to rotate the port plate upon demand. Preferably, the angular positioning means includes an electrically driven displacement device.

In a highly preferred embodiment, the electrically driven displacement device may advantageously comprise a stepper motor. The apparatus also may include an electronic system controller operatively associated with the electrically driven displacement device for causing the port plate to rotate upon demand. In this manner, there is no need for a hydraulic servo valve thus eliminating leakage while providing a more efficient system.

Further details of the invention include the valve block having a valve surface in engagement with the port plate. The valve surface advantageously includes a valve slot in communication with the port slot and also in communication with the hydraulic fluid inlet port. With this arrangement, the port slot is movable relative to the valve slot to vary displacement of the hydraulic apparatus.

As will be appreciated, the port plate is thus variably angularly positionable about the axis of the hydraulic apparatus in a manner adapted to vary displacement thereof. Thus, with the electrically driven displacement device directly coupled to the port plate, the port plate is driven upon demand so as to rotate about the axis of the hydraulic apparatus. In this connection, the port plate preferably has a pair of port slots therethrough wherein one of the port slots is movable relative to the valve slot in the valve block.

Other objects, advantages and features of the present invention will become apparent from a consideration of the following specification taken in conjunction with the accompanying drawings.

DETAILED DESCRIPTION OF THE PREFERRED EMBODIMENT

Figure 1:
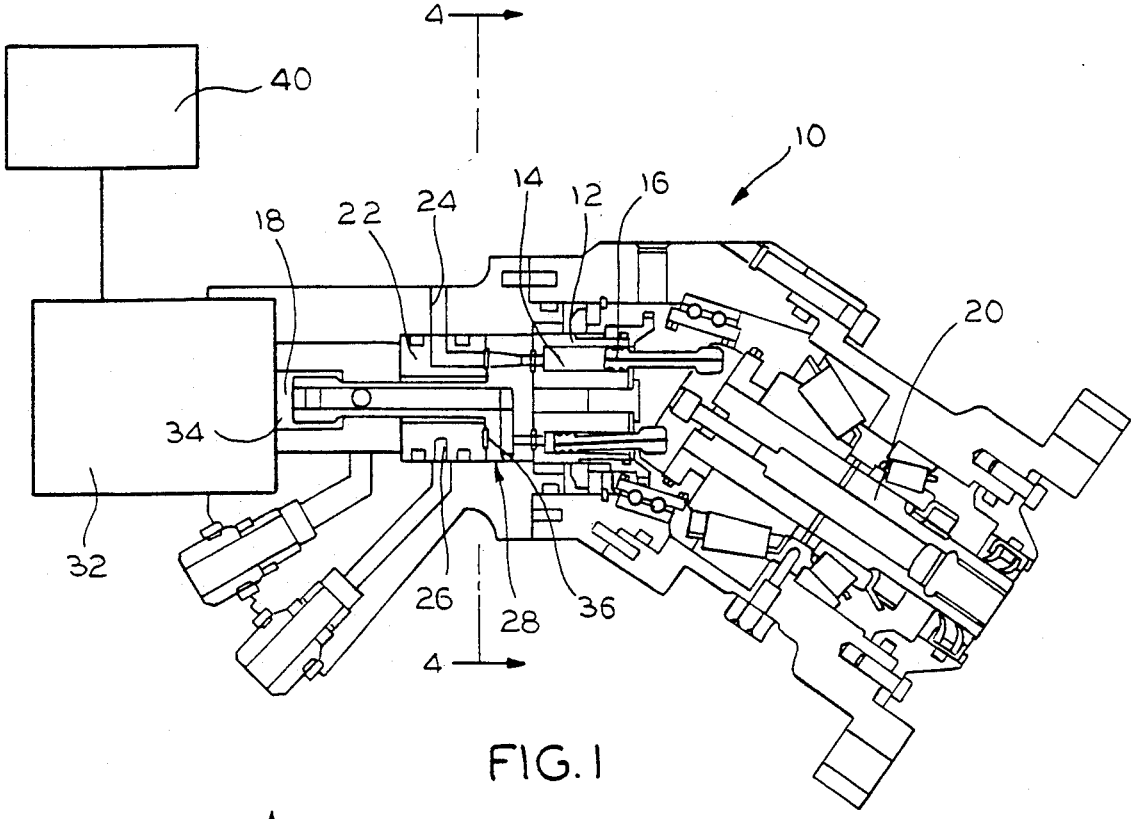
FIG. 1 is a cross sectional view of a variable displacement hydraulic apparatus in accordance with the present invention.

Referring to the drawings, and first to FIG. 1, the reference numeral 10 designates generally a variable displacement hydraulic apparatus in accordance with the present invention. The hydraulic apparatus 10 includes a cylinder block generally designated 12 having a plurality of cylinders 14 therein. Each of the cylinders 14 has a hydraulic piston 16 disposed therein for reciprocating movement relative thereto. The hydraulic apparatus 10 is also such that the cylinders 14 and pistons 16 are disposed about an axis 18 thereof. Additionally, the hydraulic apparatus 10 includes a shaft 20 which is operatively associated with the pistons 16 for relative driven movement therebetween.

Still referring to FIG. 1, the hydraulic apparatus 10 includes a valve block 22 having a hydraulic fluid inlet port 24 for supplying hydraulic fluid to the cylinders 14 and a hydraulic fluid outlet port 26 for returning hydraulic fluid from the cylinders 14. The inlet and outlet ports 24 and 26, respectively, communicate with the cylinders 14 through a port plate generally designated 28 (see, also, FIGS. 2 and 3) having at least one port slot 30 therethrough. The port plate 28 is variably angularly positionable relative to the inlet and outlet ports 24 and 26, respectively, for varying displacement of the hydraulic apparatus 10. More specifically, the hydraulic apparatus 10 is provided with means for angularly positioning the port plate 28 in a manner capable of varying displacement of the apparatus.

In the illustrated embodiment, the angular positioning means includes an electrically driven displacement device schematically illustrated as at 32 in FIG. 1. This electrically driven displacement device 32, which may advantageously comprise a stepper motor, is directly coupled to the port plate 28 so as to impart a direct drive thereto as by means of the shaft 34. With this arrangement, the port plate 28 rotates upon demand solely be means of balanced torsional forces imparted through the electrically driven displacement device 32.

Figure 4:
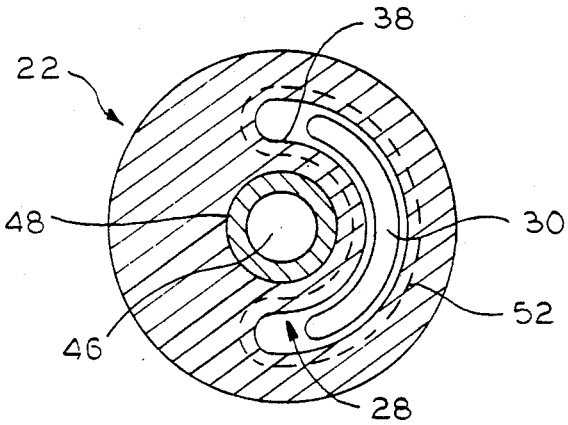
FIG. 4 is a cross sectional view taken on the line 4—4 of FIG. 1

As will be appreciated from FIG. 1, the valve block 22 includes a valve surface 36 in engagement with the port plate 28. It will also be appreciated from FIG. 4 that the valve block 22 will have a valve slot 38 extending inwardly from the valve surface 36 so as to be in communication with the port slot 30, and the valve slot 38 is in communication with the hydraulic fluid inlet port 24. With this arrangement, the port slot 30 is movable by means of the electrically driven displacement device 32 relative to the valve slot 38.

In the preferred embodiment, the electrically driven displacement device or stepper motor 32 is operable through a 180° arc for the purpose of turning the port plate 28. 180°, or plus or minus 90°, is the amount of travel required or available to drive the port plate 28 in both directions, i.e., for clockwise and/or counterclockwise rotation. By utilizing an electronic system controller 40 (see FIG. 1), the port slot 30 can be moved relative to the valve slot 38 in a desired manner to vary displacement of the hydraulic apparatus 10.

Figure 3:
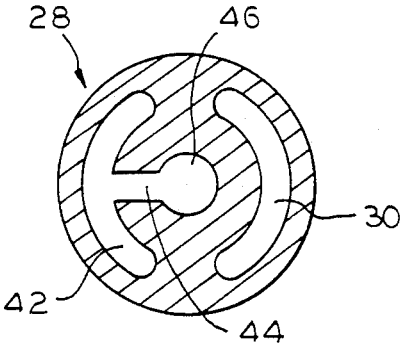
FIG. 3 is a cross sectional view taken on the line 3—3 of FIG. 2.

Referring to FIG. 3, the port plate 28 preferably includes a pair of port slots 30 and 42 arranged substantially as illustrated. The valve surface 36, as previously mentioned, has a valve slot 38 which is in communication with the one of the port slots 30 as well as in communication with the hydraulic fluid inlet port 24. As also mentioned, the one of the port slots 30 is movable relative to the valve slot 38 for varying displacement of the hydraulic apparatus 10.

Figure 2:
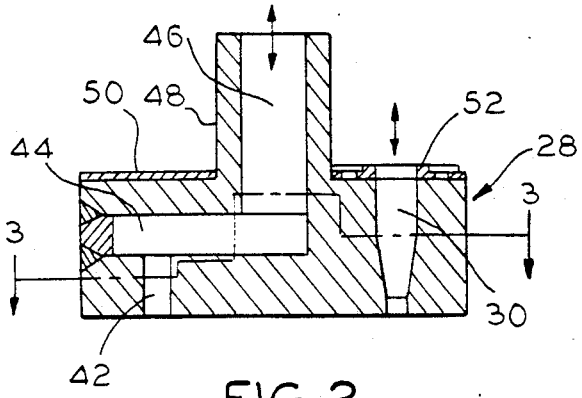
FIG. 2 is a cross sectional view of a port plate for the hydraulic apparatus of FIG. 1.

Referring to FIGS. 2 and 3, the port plate 28 is such that the other of the port slots 42 communicates with the hydraulic fluid outlet port 26 through a radially extending passage 44 which leads to an axial passage 46 defined by a tubular extension 48. This will be apparent from FIGS. 2 and 3 wherein it will also be seen that various seals such as at 50 and 52 may also advantageously be provided. For still other details of the port plate 28 illustrated in FIGS. 2 and 3, attention is directed to commonly owned U.S. Pat. No. 4,875,403 issued Oct. 24, 1989 incorporated herein by reference.

As will be appreciated, the hydraulic apparatus has been described without reference to many of the details illustrated in FIG. 1. It should be noted in this connection that it matters not whether the present invention is utilized with a hydraulic pump, a hydraulic motor or some other hydraulic apparatus inasmuch as the unique advantages of the present invention are fully available for any type of hydraulic apparatus. However, for purposes of supplementing this disclosure, the details of the above noted patent application have been incorporated herein by reference, as noted hereinabove.

While in the foregoing there has been set forth a preferred embodiment of the invention, it will be appreciated that the details herein given may be varied by those skilled in the art without departing from the true spirit and scope of the appended claims.

I claim:

1. A variable displacement hydraulic apparatus, comprising:

a cylinder block having a plurality of hydraulic cylinders therein, each of said hydraulic cylinders having a hydraulic piston disposed therein for reciprocating movement relative thereto, said hydraulic cylinders and pistons being disposed about an axis of said hydraulic apparatus;

a shaft operatively associated with said hydraulic pistons for relative driven movement therebetween;

a valve block having a hydraulic fluid inlet port for supplying hydraulic fluid to said hydraulic cylinders and a hydraulic fluid outlet port for returning hydraulic fluid from said hydraulic cylinders, said hydraulic fluid inlet port and hydraulic fluid outlet port communicating with said hydraulic cylinders through a port plate having at least one port slot therethrough, said port plate being variably angularly positionable relative to said hydraulic fluid inlet port and hydraulic fluid outlet port for varying displacement of said hydraulic apparatus; and means for angularly positioning said port plate for varying displacement of said hydraulic apparatus, said angular positioning means being directly coupled to said port plate, said angular positioning means being electrically driven to rotate said port plate upon demand.

2. The variable displacement hydraulic apparatus as defined in claim 1 wherein said angular positioning means includes an electrically driven displacement device.

3. The variable displacement hydraulic apparatus as defined in claim 2 wherein said electrically driven displacement device comprises a stepper motor.

4. The variable displacement hydraulic apparatus as defined in claim 1 including an electronic system controller for said angular positioning means.

5. The variable displacement hydraulic apparatus as defined in claim 4 wherein said angular positioning means includes an electrically driven displacement device.

6. The variable displacement hydraulic apparatus as defined in claim 1 wherein said valve block includes a valve surface in engagement with said port plate.

7. The variable displacement hydraulic apparatus as defined in claim 6 wherein said valve surface includes a valve slot in communication with said port slot.

8. The variable displacement hydraulic apparatus as defined in claim 7 wherein said valve slot is also in communication with said hydraulic fluid inlet port.

9. The variable displacement hydraulic apparatus as defined in claim 7 wherein said port slot is movable relative to said valve slot to vary displacement.

10. A variable displacement hydraulic apparatus, comprising:

a cylinder block having a plurality of hydraulic cylinders therein, each of said hydraulic cylinders having a hydraulic piston disposed therein for reciprocating movement relative thereto, said hydraulic cylinders and pistons being disposed about an axis of said hydraulic apparatus;

a shaft operatively associated with said hydraulic pistons for relative driven movement therebetween;

a valve block having a hydraulic fluid inlet port for supplying hydraulic fluid to said hydraulic cylinders and a hydraulic fluid outlet port for returning hydraulic fluid from said hydraulic cylinders, said hydraulic fluid inlet port and hydraulic fluid outlet port communicating with said hydraulic cylinders through a port plate having a pair of port slots therethrough, said port plate being variably angularly positionable about said axis of said hydraulic apparatus in a manner adapted to vary displacement of said hydraulic apparatus;

means for angularly positioning said port plate for varying displacement of said hydraulic apparatus, said angular positioning means including an electrically driven displacement device directly coupled to said port plate, said electrically driven displacement device being adapted to rotate said port plate upon demand; and an electronic system controller for said electrically driven displacement device.

11. The variable displacement hydraulic apparatus as defined in claim 10 wherein said electrically driven displacement device comprises a stepper motor.

12. The variable displacement hydraulic apparatus as defined in claim 10 wherein said valve block includes a valve surface in engagement with said port plate.

13. The variable displacement hydraulic apparatus as defined in claim 12 wherein said valve surface includes a valve slot in communication with one of said port slots.

14. The variable displacement hydraulic apparatus as defined in claim 13 wherein said valve slot is also in communication with said hydraulic fluid inlet port.

15. The variable displacement hydraulic apparatus as defined in claim 13 wherein said one of said port slots is movable relative to said valve slot to vary displacement.

16. A variable displacement hydraulic apparatus, comprising:

a cylinder block having a plurality of hydraulic cylinders therein, each of said hydraulic cylinders having a hydraulic piston disposed therein for reciprocating movement relative thereto, said hydraulic cylinders and pistons being disposed about an axis of said hydraulic apparatus;

a shaft operatively associated with said hydraulic pistons for relative driven movement therebetween;

a valve block having a hydraulic fluid inlet port for supplying hydraulic fluid to said hydraulic cylinders and a hydraulic fluid outlet port for returning hydraulic fluid from said hydraulic cylinders, said hydraulic fluid inlet port and hydraulic fluid outlet port communicating with said hydraulic cylinders through a port plate having a pair of port slots therethrough, said port plate being variably angularly positionable about said axis of said hydraulic apparatus in a manner adapted to vary displacement of said hydraulic apparatus;

said valve block including a valve surface in engagement with a confronting surface of said port plate, said valve surface having a valve slot in communication with one of said pair of port slots, said one of said port slots being movable about said axis of said hydraulic apparatus to vary displacement;

means for variably angularly positioning said port plate relative to said valve slot for varying displacement of said hydraulic apparatus, said angular positioning means including an electrically driven displacement device directly coupled to said port plate, said electrically driven displacement device being adapted to rotate said port plate about said axis of said hydraulic apparatus; and an electronic system controller for said electrically driven displacement device.

17. The variable displacement hydraulic apparatus as defined in claim 16 wherein said electrically driven displacement device comprises a stepper motor.

18. The variable displacement hydraulic apparatus as defined in claim 16 wherein said valve slot is also in communication with said hydraulic fluid inlet port.

* * * * *